United States Patent [19]

Maruhashi et al.

[11] Patent Number: 4,594,114

[45] Date of Patent: Jun. 10, 1986

[54] PROCESS FOR PRODUCING STRIP OF CORROSION RESISTANT ALLOY STEEL

[75] Inventors: Shigeaki Maruhashi; Kazuo Hoshino; Yoshihiro Uematsu; Katsuhisa Miyakusu; Takehiko Fujimura, all of Yamaguchi, Japan

[73] Assignee: Nisshin Steel Co., Ltd., Tokyo, Japan

[21] Appl. No.: 634,020

[22] PCT Filed: Dec. 28, 1983

[86] PCT No.: PCT/JP83/00462

§ 371 Date: Jul. 24, 1984

§ 102(e) Date: Jul. 24, 1984

[87] PCT Pub. No.: WO84/02535

PCT Pub. Date: Jul. 5, 1984

[30] Foreign Application Priority Data

Dec. 29, 1982 [JP] Japan ..... 57-230833

[51] Int. Cl.[4] ..... C21D 00/08

[52] U.S. Cl. ..... 148/12 EA; 148/37

[58] Field of Search ..... 75/124 C, 124 F, 126 K, 75/128 P; 148/37, 12 EA

[56] References Cited

FOREIGN PATENT DOCUMENTS 55134128 10/1980 Japan ..... 148/12 EA 1209345 10/1970 United Kingdom ..... 148/12 EA

*Primary Examiner*—L. Dewayne Rutledge

*Assistant Examiner*—Deborah Yee

*Attorney, Agent, or Firm*—Wenderoth, Lind & Ponack

[57] ABSTRACT

A process for the production of a strip of a corrosion resistant alloy steel having excellent workability, which process comprises subjecting a cold rolled strip of a steel containing in % by weight as essential components up to 0.05% of C, 10.00 to 18.00% of Cr, 0.005 to 0.50% of sol. Al and more than 0.040% but not more than 0.150% of P to a final annealing, said final annealing being carried out by heating the cold rolled strip in a box annealing furnace to an annealing temperature within the range between 650° C. and 900° C., and maintaining the strip in the furnace at the annealing temperature, the rate of heating at which the strip is heated from 300° C. to the annealing temperature being not faster than 300° C./hr.

15 Claims, 1 Drawing Figure

PROCESS FOR PRODUCING STRIP OF CORROSION RESISTANT ALLOY STEEL

TECHNICAL FIELD OF THE INVENTION

The present invention relates to a process for the production of a strip of a corrosion resistant alloy steel having excellent workability.

BACKGROUND OF THE INVENTION

The inventors have newly developed a corrosion resistant alloy having improved workability and pickling performance which comprises in % by weight up to 0.05% of C, 10.00 to 18.00% of Cr, up to 1.00% of Si, up to 1.00% of Mn, more than 0.040% but not more than 0.150% of P, up to 0.050% of S, up to 0.60% of Ni and 0.005 to 0.50% of sol. Al, and optionally one or both of up to 1.00% of Cu and up to 1.00% of Mo, and further optionally one or both of up to 0.50% of Ti and up to 0.50% of Nb in an amount of up to 0.50% in total, the balance being Fe and unavoidable impurities.

The invention provides a process for the production of a cold rolled strip of the above-mentioned novel alloy, which process permits the production of a product having a further enhanced workability, thereby to provide an inexpensive strip of the corrosion resistant alloy steel having an excellent workability.

Whem compared with existing ferritic stainless steels, a variety of corrosion resistant materials, our novel alloy is prescribed so that it contains a higher level of P(more than 0.040% but not more than 0.150% P) than that of the existing ferritic stainless steels, although our alloy has a corrosion resistance comparable to that of the existing ferritic stainless steels. Accordingly, it is possible to prepare our alloy by directly feeding pig iron from a blast furnace to a converter without the necessity of a special treatment for removing P from such pig iron and adding suitable subsidiary materials such as Fe-Cr alloys to the converter. In addition, the pickling performance of hot rolled strips is for superior with our alloy than with the existing ferritic stainless steels. Accordingly, enhancement of the productivity and great reduction in the manufacturing costs may be enjoyed with our new alloy, enabling the provision of inexpensive strips of a corrosion resistant alloy steel.

Thus, strips of the new alloy can be a substitute for the existing strips of ferritic stainless steels. Moreover, they may be used in such applications where plated or coated strips of ordinary steels cheaper than stainless steels have heretofore been used although they are not satisfactory regarding corrosion resistance.

In many cases steel strips are used after having been formed into shapes, e.g., by pressing, and therefore, the workability of steel strips is very important. With the novel alloy discussed above a further improvement of the workability is strongly desired.

Cold rolled strips or sheets of ferritic stainless steels are basically produced by a process including the steps of hot rolling a slab to a hot rolled strip (or sheet), optionally annealing the hot rolled strip, descaling the strip by pickling, cold rolling the strip and subjecting the cold rolled strip to a final or finish annealing. The cold rolling may be carried out in one stage or in multiple stages. In the latter case, an intermediate annealing may be carried between any adjacent stages of cold rolling.

As to annealing, there are two types of, one is a continuous annealing while the other is box annealing. In a continuous annealing, a running steel strip is caused to pass through an annealing furnace maintained at a predetermined annealing temperature. Usually the material to be annealed is rapidly heated at a rate of heating of at leasst 200° C./min. and allowed to cool in air. Accordingly, the period of time during which the material is held at the annealing temperature is very short.

On the other hand in a box annealing a stationary steel strip in the form of a coil is annealed. Usually the material is slowly heated at a rate of heating of 300° C./hr or below. A period of time during which the material is held at the annealing temperature is much longer than that in a continuous annealing, and the annealed material is slowly cooled, e.g., by being allowed to stand in the annealing furnace.

While an anneal of a hot rolled strip of ferritic stainless steel may be carried out either in a box annealing furnace at a slow rate of heating or in a continuous anneal furnace at a fast rate of heating, a final annealing in the case of one stage cold rolling as well as any intermediate annealing or annealings and a final annealing in the case of multiple stage cold rolling have been normally carried out in a continuous annealing furnace at a fast rate of heating.

DESCRIPTION OF THE INVENTION

The inventors have found that the workability of the corrosion resistant alloy having P enriched can be further enhanced if the final annealing is carried out in a box anneal furnace at a slow rate of heating rather than in a continuous annealing furnace at a fast rate of heating as is the case with the existing ferritic stainless steels. More particularly, it has been found that if the final annealing of the cold rolled strip is carried out by heating the cold rolled strip at a rate of heating of 300° C./hr or below to an annealing temperature as is the case with a box annealing, the workability of the product can be greatly improved irrespective of the presence or absence, of anneal of the hot rolled strip, of types of annealing of the hot rolled strip and of the presence or absence of any intermediate annealings.

Thus, the invention provides a process for the production of a strip of a corrosion resistant alloy steel having an excellent workability comprising the steps of feeding a hot rolled strip of a steel containing in % by weight as essential components up to 0.05% of C, 10.00 to 18.00% of Cr, 0.005% to 0.50% of sol. Al and more than 0.040% but not more than 0.150% of P, advantageously 0.045 to 0.150% of P, to a cold rolling step (a) without annealing it, or (b) after having annealed it in a box annealing furnace in which it is heated at a rate of heating of 300° C./hr or below, or (c) after having annealed it in a continuous annealing furnace in which it is heated at a rate of heating of at least 200° C./min.; cold rolling the hot rolled strip in a single or multiple stages, optionally carrying out an intermediate annealing between any adjacent cold rolling stages when the cold rolling is carried out in multiple stages, and finally subjecting the cold rolled strip to a final annealing, said final annealing being carried out by heating the cold rolled strip at an annealing temperature within the range between 650° C. and 900° C., the rate of heating for heating the strip at least within the range from 300° C. to the annealing temperature being controlled 300° C./hr or below. As demonstrated in detail hereinbelow, in all cases of (a), (b) and (c) above, an excellent workability of cold rolled products can be achieved irrespective of the presence or absence of the step of annealing the hot rolled strip and irrespective of types of annealing of the hot rolled strip.

As stated in the beginning, the steel envisaged in the method according to the invention is a corrosion resistant alloy steel developed by the inventors, characterized in that it comprises in % by weight as essential components up to 0.05% of C, 10.00 to 18.00% Cr, 0.005 to 0.50% of sol. Al and more than 0.040 but not more than 0.150% of P. In addition to these components it normally contains up to 1.00% of Si, up to 1.00% of Mn, up to 0.050% of S and up to 0.60% of Ni. The steel may further comprises up to 1.00% of Mo and/or up to 1.00% of Cu added for the purpose of improving the corrosion resistance, and further up to 0.50% of Ti and/or 0.50% of Nb in an amount of up to 0.50% in total added for the purpose of improving the corrosion resistance and mechanical properties. The reasons for the numerical restrictions of the alloying elements are as follows.

If C is excessively high, a martensitic phase locally formed after hot rolling tends to be unduly rigid. This fact cooperates with the enrichment of P not only to impair the toughness and elongation of the material as hot rolled but also to adversely affect the toughness, workability and weldability of the cold rolled and annealed product. To avoid these inconveniences it is required to set the upper limit at C 0.05%. The lower limit of 10.00% of Cr is required to achieve the corrosion resistance. An excessively high Cr content impairs the toughness of the material, and cooperates with the enrichment of P to result in a remarkably brittle product. For this reason the upper limit of Cr is set 18.00%. Si and Mn each may be present in an amount of up to 1.00% as normally permitted in a stainless steels. A high content of S tends to adversely affect the corrosion resistance and hot workability of the material. Thus, the lower the content of S the more preferable. The allowable upper limit of S is now set 0.050%, considering the fact that a pig iron from a blast furnace contains a substantial amount of S and intending to use such a pig iron without any treatment for the removal of S. Ni has an effect of improving the toughness of ferritic materials. But a high content of Ni renders the product expensive. Accordingly, the upper limit of Ni prescribed with normal ferritic stainless steels is adopted as the allowable limit of Ni in alloys according to the invention. Thus, N is now set at up to 0.60%. With not more than 0.040% of P, a preliminary removal of P from a pig iron or a special treatment for the removal of P in the converter is required, and therefore, the advantage of inexpensive production of corrosion resistance is lost. In addition an effect of an improved workability and pickling performance due to the enrichment of P is not enjoyed. Accordingly, more than 0.040% of P, advantageously at least 0.045% of P is required. On the other hand, the presence of P in excess of 0.150% is not preferred from the view points of the toughness and hot workability and also tends to lower the cold workability. The upper limit of P is now set 0.150%. Soluble Al contributes to compensate a reduction of the toughness due to the enrichment of P to some extent and to improve the workability. Such effects are insufficient with less than 0.005% of sol. Al. With more than 0.50% of sol. Al, such effects tends to be saturated and the product becomes expensive. For these reasons, the content of sol. Al is set from 0.005 to 0.50%. Cu and Mo each has an effect to improve the corrosion resistance. But inclusion of such an element in an excessively high amount renders the product expensive. The upper limit of Cu and Mo each is now set 1.00%. Ti and Nb each forms compounds with C or N and has effects as a stabilizing element to improve the toughness, corrosion resistance, in particular resistance to intergranular corrosion, and mechanical properties. But with more than 0.50% such effects tend to be saturated and the product becomes expensive. Accordingly, the upper limit of Ti and Nb is set 0.50% in total.

The reasons for the numerical restrictions of the conditions of the final annealing are as follows.

The material should be heated at least within the range from 300° C. to a predetermined annealing temperature at a rate of heating of 300° C./hr or below. When the temperature of the material is below 300° C., no substantial recovery or recrystallization of the material occurs, and therefore the rate of heating is not critical. However, when the temperature of the material is substantially higher than 300° C., the rate of heating appreciably affects the workability of the product. With a rate of heating of in excess of 300° C./hr an attainable improvement of the workability is frequently unsatisfactory. Thus the upper limit of the rate of heating within the range of higher temperatures is now set 300° C./hr or below. Even in a case wherein the final annealing is carried out in two stages that is wherein the material is heated to a first annealing temperature, maintained at that temperature, heated to a second annealing temperature, which is higher than the first annealing temperature, and maintained at the second annealing temperature, it is sufficient for the purpose of the invention to control the rate of heating at least within the temperature range of 300° C. to the maximum annealing temperature 300° C./hr or below.

The maximum annealing temperature should be within the range between 650° C. and 900° C. With an annealing temperature of substantially below 650° C., satisfactory recrystallization is not achieved, while as the annealing temperature exceeds 900° C., the grains tend to become unduly coarse resulting in poor appearance of worked products. The period of time for which the cold strip is maintained at the annealing temperature is not strictly critical.

BRIEF EXPLANATION OF THE DRAWINGS

The sole drawing.

Figure 1:
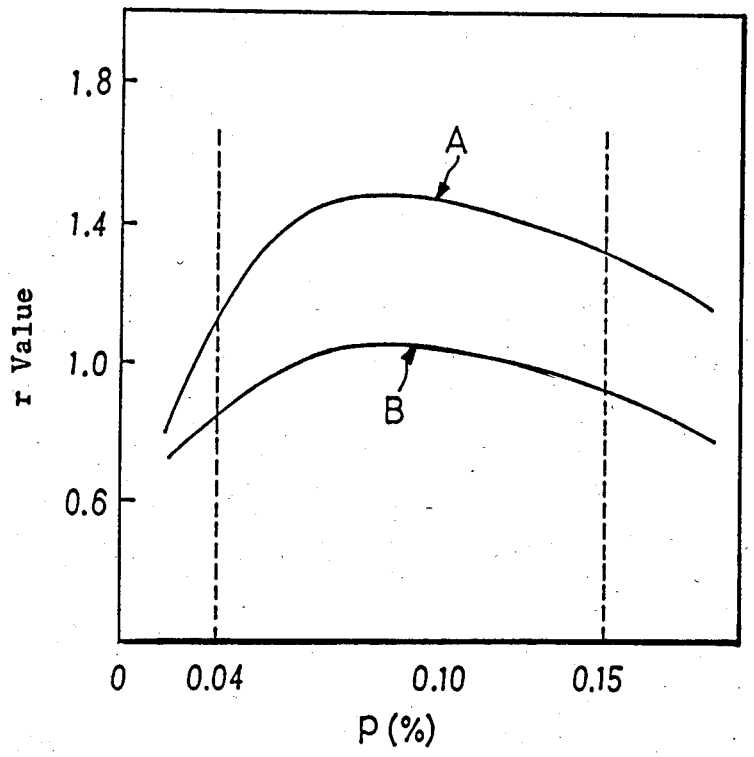
FIG. 1 is a graph showing the effect of P on the r value in respective cases of different types of the final annealing.

Curve A in FIG. 1 was obtained on samples prepared from various corrosion resistant alloys basically containing 13% of Cr, 0.02% of C and 0.01% of N as well as various amounts of P by hot rolling each alloy in a conventional manner, and thereafter without annealing the hot rolled sheet descaling it, subjecting the descaled sheet to a single step of cold rolling and subjecting the cold rolled sheet to a finish annealing in a box annealing furnace in which the cold sheet was heated at a slow rate of heating of 120° C./hr. Curve B in FIG. 1 was obtained on samples prepared following the above-mentioned procedure except that the finish annealing was carried out in a continuous anneal furnace in which the material was heated at a fast rate of heating of 400° C./min. As revealed from FIG. 1, while the improved r values are obtained in either type of annealing if the P content of the alloy is within the range from 0.040 to 0.150%, the improvement of the r value is more remarkable when the final annealing has been carried out in a box annealing furnace. Thus, it can be understood that the improvement of the workability by the enrichment of P can be made more remarkable by carrying out the final annealing in a box annealing furnace at a slow rate of heating.

BEST MODE FOR CARRYING OUT THE INVENTION

The invention will be further described by the following working and control examples.

In the following examples hot rolled sheets having a thickness of 3.2 mm were prepared from molten steels having chemical compositions indicated in Table 1.

TABLE 1

| | Chemical Composition of Steels used in Examples (% by weight) | | | | | | | | | | | | | |
|---|---|---|---|---|---|---|---|---|---|---|---|---|---|---|
| Steel | C | Si | Mn | P | S | Cr | Ni* | Mo* | Cu* | Ti* | Nb* | Sol. Al | N | Balance |
| A | 0.010 | 0.05 | 0.21 | 0.051 | 0.006 | 11.42 | — | — | — | — | | 0.052 | 0.007 | Fe and unavoidable impurities |
| B | 0.017 | 0.18 | 0.25 | 0.078 | 0.010 | 13.02 | — | — | — | — | | 0.043 | 0.008 | " |
| C | 0.043 | 0.47 | 0.25 | 0.068 | 0.004 | 16.71 | — | — | — | — | | 0.130 | 0.012 | " |
| D | 0.023 | 0.34 | 0.20 | 0.075 | 0.003 | 17.27 | — | 0.80 | — | — | | 0.050 | 0.007 | " |
| E | 0.031 | 0.40 | 0.23 | 0.082 | 0.005 | 17.83 | 0.30 | — | 0.50 | — | | 0.018 | 0.010 | " |
| F | 0.026 | 0.33 | 0.27 | 0.078 | 0.004 | 16.47 | — | — | — | 0.15 | | 0.020 | 0.012 | " |
| G | 0.018 | 0.37 | 0.18 | 0.095 | 0.010 | 16.50 | — | — | — | — | 0.42 | 0.032 | 0.011 | " |
| H | 0.047 | 0.42 | 0.21 | 0.080 | 0.032 | 16.23 | — | — | — | — | | 0.350 | 0.009 | " |
| I | 0.014 | 0.35 | 0.29 | 0.073 | 0.003 | 17.52 | — | 0.92 | — | — | 0.44 | 0.020 | 0.012 | " |
| J | 0.047 | 0.42 | 0.23 | 0.027 | 0.008 | 16.66 | — | — | — | — | | 0.004 | 0.013 | " |

*Blanks for Ni, Mo, Cu, Ti and Nb indicate an amount contained as impurities.

EXAMPLE 1

Starting from hot rolled sheets of steels A, B, C and J indicated in Table 1, steel sheets having a thickness of 0.7 mm were prepared by cold rolling and annealing using conditions of anneals indicated in Table 2.

The sheets so prepared were tested for the elongation, r value, Erichsen value and CCV. The results are shown in Table 2.

TABLE 2

| | | Conditions of anneals* | | | | | | |
|---|---|---|---|---|---|---|---|---|
| Steel | Classification | Annealing of hot rolled sheet | Intermediate annealing | Final Annealing | elongation** (%) | r** value | Erichsen value (mm) | CCV |
| A | according to this invention | not done | not done | BA, HR; 120° C./hr, 820° C. × 4 hrs FC | 34.5 | 1.29 | 10.6 | 27.7 |
| A | according to this invention | CA, HR; 400° C./min 850° C. × 1 min, AC | not done | | 34.1 | 1.32 | 10.6 | 27.6 |
| B | according to this invention | not done | not done | | 33.4 | 1.41 | 10.7 | 27.5 |
| B | according to this invention | CA, HR; 400° C./min 850° C. × 1 min, AC | not done | | 33.8 | 1.50 | 10.8 | 27.2 |
| C | according to this invention | not done | not done | | 31.7 | 1.25 | 10.4 | 27.6 |
| C | according to this invention | BA, HR; 50° C./hr, 800° C. × 4 hrs, FC | not done | | 30.9 | 1.43 | 10.5 | 27.3 |
| A | Control | not done | not done | CA, HR; 400° C./min, 820° C. × 1 min, AC | 31.6 | 0.97 | 10.1 | 28.2 |
| B | Control | not done | not done | | 30.1 | 1.18 | 10.2 | 27.9 |
| C | Control | not done | not done | | 28.2 | 1.10 | 10.1 | 28.2 |
| C | Control | BA, HR; 50° C./hr 800° C. × 4 hrs, FC | not done | | 28.5 | 1.15 | 10.3 | 28.0 |
| J | Control | not done | not done | | 27.9 | 0.80 | 9.4 | 29.3 |
| J | Control | not done | not done | BA, HR; 120° C./hr 820° C. × 4 hrs, FC | 28.4 | 0.85 | 9.5 | 28.9 |

*Keys for abbreviations: CA; Continuous annealing, BA; Box annealing, HR; heating rate, FC; Furnace cooling, AC; Air cooling
**Weight average of test values in directions of 0°, 45°, and 90° against the direction of rolling, e.g., $r = (r_0 + 2r_{45} + r_{90})/4$.

As revealed from the results shown in Table 2, with steels A, B and C which are envisaged by the invention, cold rolled products having an excellent workability as reflected by their satisfactory elongation, r value, Erichsen value and CCV (the smaller the CCV the better the ability of being deeply drawn) may be obtained irrespective of the presence or absence of annealing the hot rolled sheet if the final annealing is carried out according to the invention in a box annealing furnace by heat the cold rolled material to an annealing temperature of 820° C. at a rate of heating of 120° C./hr, maintaining the material at this temperature for 4 hours and allowing it to cool in the furnace.

Steel J having a reduced P content is not envisaged by the invention. With steel J, even if the final annealing is carried out in a box annealing furnace by heating the cold rolled material to an annealing temperature of 820° C. at a rate of heating of 120° C./hr, maintaining the material at this temperature for 4 hours and allowing it to cool in the furnace, the product so obtained has parameters which are not substantially different from those of the product obtained by carrying out the final annealing in a continuous anneal furnace, indicating the fact that the type of the final annealing is not critical with such a steel of a reduced P content.

When compared with the products made with steel J, steels A, B and C envisaged by the invention provide products having better parameters even in the final annealing is carried out in a continuous furnace by rapidly heating the cold rolled material at a rate of heating of 400° C./min. to an annealing temperature of 820° C., maintaining the material at this temperature for one minute and cooling it in air. It can be appreciated that further improved results are obtainable with steels A, B and C if the final annealing is carried out in a box anneal furnace according to the invention by heating the cold rolled material to an annealing temperature of 820° C. at a rate of heating of 120° C./hr, maintaining the material at this temperature for 4 hours and allowing it to cool in the furnace.

EXAMPLE 2

Starting from hot rolled sheets of steels D, E and I indicated in Table 1, steel sheets having a thickness of 0.7 mm were prepared by cold rolling and annealing using conditions of anneals indicated in Table 3. In the cases wherein the intermediate annealing was carried out, the material was cold rolled to a thickness of 1.8 mm, subjected to the intermediate annealing indicated in the table and then cold rolled to the final thickness.

The sheets so prepared were tested for the elongation, r value, Erichsen value and CCV. The results are shown in Table 3.

TABLE 3

| Steel | Classification | Conditions of anneals* Annealing of hot rolled sheet | Intermediate annealing | Final annealing | elongation** | r** value | Erichsen value (mm) | CCV |
|---|---|---|---|---|---|---|---|---|
| D | According to this invention | BA, HR; 50° C./hr 800° C. × 4 hrs FC | not done | BA, HR; 80° C. hr 820° C. × 4 hrs FC | 29.8 | 1.33 | 10.3 | 27.6 |
| D | According to this invention | | CA, HR; 400° C./min 840° C. × 1 min, AC | | 30.0 | 1.45 | 10.3 | 27.5 |
| E | According to this invention | BA, HR; 50° C./hr 850° C. × 4 hrs FC | not done | | 31.2 | 1.48 | 10.9 | 27.3 |
| E | According to this invention | | CA, HR; 400° C./min 860° C. × 1 min, AC | | 31.5 | 1.53 | 11.2 | 27.2 |
| I | According to this invention | CA, HR; 400° C./min 900° C. × 1 min AC | not done | | 28.9 | 1.60 | 11.0 | 27.2 |
| I | According to this invention | | CA, HR; 400° C./min 900 PC × 1 min, AC | | 30.1 | 1.72 | 11.1 | 27.1 |
| D | Control | BA, HR; 50° C./hr 800° C. × 4 hrs, FC | not done | CA, HR; 400° C./min 840° C. × 1 min AC | 28.2 | 0.94 | 9.6 | 28.2 |
| E | Control | BA, HR; 50° C./hr 850° C. × 4 hrs, FC | not done | CA, HR; 400° C./min 860° C. × 1 min, AC | 29.2 | 1.14 | 10.4 | 27.9 |
| I | Control | CA, HR; 400° C./min 900° C. × 1 min, AC | not done | CA, HR; 400° C./min 900° C. × 1 min AC | 27.5 | 1.30 | 10.3 | 27.8 |

*Keys for abbreviations: - Same as in Table 2.
**Calculated in the same manner as in Table 2.

As revealed from the results shown in Table 3, products having improved parameters and thus an enhanced workability can be obtained if the final anneal is carried out in a box annealing furnace according to the invention by heating the cold rolled material to an annealing temperature of 820° C. at a rate of heating of 80° C./hr, maintaining the material at this temperature for 4 hours and allowing it to cool in the furnace. It appears that better parameters are obtained in the case wherein the intermediate annealing is carried out.

EXAMPLE 3

Starting from hot rolled sheets of steels F, G and H indicated in Table 1, steel sheets having a thickness of 0.7 mm were prepared by cold rolling and annealing using conditions of anneals indicated in Table 4. The intermediate annealing was carried out with the material having a thickness of 1.8 mm .

TABLE 4

| Steel | Classification | Conditions of anneals* Annealing of hot rolled sheet | Intermediate annealing | Final annealing | Elongation (%)** | r** value | Erichsen value (mm) | CCV |
|---|---|---|---|---|---|---|---|---|
| F | According to this invention | not done | CA, HR; 400° C./min 840° C. × 1 min, AC | BA, HR; 200° C./hr 820° C. × 1 hr, FC | 32.0 | 1.50 | 11.0 | 27.3 |
| G | According to this invention | not done | CA, HR; 400° C./min 900° C. × 1 min, AC | BA, HR; 200° C./hr 840° C. × 1 hr, FC | 30.4 | 1.70 | 11.0 | 27.2 |
| H | According to this invention | not done | CA, HR; 400° C./min 840° C. × 1 min, AC | BA, HR; 200° C./hr 820° C. × 1 hr, FC | 29.6 | 1.42 | 10.4 | 27.6 |
| F | Control | not done | CA, HR; 400° C./min 840° C. × 1 min, AC | CA, HR; 400° C./min 840° C. × 1 min, AC | 31.2 | 1.38 | 10.3 | 27.7 |
| G | Control | not done | CA, HR; 400° C./min 900° C. × 1 min, AC | CA, HR; 400° C./min 900° C. × 1 min, AC | 28.8 | 1.27 | 10.2 | 27.9 |
| H | Control | not done | CA, HR; 400° C./min 840° C. × 1 min, AC | CA, HR; 400° C./min 840° C. × 1 min, AC | 28.3 | 1.15 | 9.7 | 28.0 |

*Keys for abbreviations: - Same as in Table 2.
**Calculated in the same manner as in Table 2.

Steels F, G and H have Ti, Nb and Al added for the purpose of enhancing the workability respectively. As revealed from the results shown in Table 4, with such steels again, products having a further improved workability can be obtained if the final annealing is carried out in a box anneal furnace according to the invention by heating the cold rolled material to an annealing temperature of 820° C. or 840° C. at a rate of heating of 200° C./hr, maintaining the material at the same temperature for 4 hours and then allowing it to cool in the furnace.

We claim:

1. A process for the production of a strip of a corrosion resistant alloy steel having excellent workability, which process comprises subjecting a cold rolled strip of a steel containing in % by weight as essential components up to 0.05% of C, 10.00 to 18.00% of Cr, 0.005 to 0.50% of sol. Al and more than 0.40% but not more than 0.150% of P to a final annealing, said final annealing being carried out by heating the cold rolled strip in a box annealing furnace to an annealing temperature within the range between 650° C. and 900° C., and maintaining the strip in the furnace at the annealing temperature, the rate of heating at which the strip is heated from 300° C. to the annealing temperature being not faster than 300° C./hr.

2. The process according to claim 1, wherein said cold rolled strip prior to final annealing is prepared by annealing a hot rolled strip of a steel having the prescribed composition in a box annealing furnace in which the hot rolled strip is heated at a rate of heating of not faster than 300° C./hr., and cold rolling the annealed strip.

3. The process according to claim 1, wherein said cold rolled strip prior to final annealing is prepared by annealing a hot rolled strip of a steel having the prescribed composition in a continuous annealing furnace in which the hot rolled strip is heated at a rate of at least 200° C./min., and cold rolling the annealed strip.

4. The process according to claim 1, wherein the steel comprises in % by weight up to 0.05% of C, 10.00 to 18.00% of Cr, up to 1.00% of Si, up to 1.00% of Mn, up to 0.050% of S, up to 0.60% of Ni, 0.005 to 0.50% of sol. Al and more than 0.040% but not more than 0.150% of P, the balance being Fe and unavoidable impurities.

5. The process according to claim 2, wherein the steel comprises in % by weight up to 0.05% of C, 10.00 to 18.00% of Cr, up to 1.00% of Si, up to 1.00% of Mn, up to 0.050% of S, up to 0.60% of Ni, 0.005 to 0.50% of sol. Al and more than 0.040% but not more than 0.150% of P, the balance being Fe and unavoidable impurities.

6. The process according to claim 3, wherein the steel comprises in % by weight up to 0.05% of C, 10.00 to 18.00% of Cr, up to 1.00% of Si, up to 1.00% of Mn, up to 0.050% of S, up to 0.60% of Ni, 0.005 to 0.50% of sol. Al and more than 0.040% but not more than 0.150% of P, the balance being Fe and unavoidable impurities.

7. The process according to claim 4, wherein the steel further comprises at least one of up to 1.00% of Mo and up to 1.00% of Cu.

8. The process according to claim 5, wherein the steel further comprises at least one of up to 1.00% of Mo and up to 1.00% of Cu.

9. The process according to claim 6, wherein the steel further comprises at least one of up to 1.00% of Mo and up to 1.00% of Cu.

10. The process according to claim 4, wherein the steel further comprises at least one of up to 0.5% of Ti and up to 0.5% of Nb in an amount of up to 0.5% in total.

11. The process according to claim 5, wherein the steel further comprises at least one of up to 0.5% of Ti and up to 0.5% of Nb in an amount of up to 0.5% in total.

12. The process according to claim 6, wherein the steel further comprises at least one of up to 0.5% of Ti and up to 0.5% of Nb in an amount of up to 0.5% in total.

13. The process according to claim 7, wherein the steel further comprises at least one of up to 0.5% of Ti and up to 0.5% of Nb in an amount of up to 0.5% in total.

14. The process according to claim 8, wherein the steel further comprises at least one of up to 0.5% of Ti and up to 0.5% of Nb in an amount of up to 0.5% in total.

15. The process according to claim 9, wherein the steel further comprises at least one of up to 0.5% of Ti and up to 0.5% of Nb in an amount of up to 0.5% in total.

* * * * *